US006483067B1

(12) United States Patent
Kamber et al.

(10) Patent No.: US 6,483,067 B1
(45) **Date of Patent: *Nov. 19, 2002**

(54) ELECTRICAL POWER DISTRIBUTION SWITCH

(75) Inventors: Ginger B. Kamber, Park Ridge, IL (US); Keith La Cour, Waukegan, IL (US); Walter A. Tyrjan, Hoffman Estates, IL (US)

(73) Assignee: S & C Electric Co., Chicago, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/537,904

(22) Filed: Mar. 28, 2000

Related U.S. Application Data

(60) Provisional application No. 60/128,710, filed on Apr. 8, 1999.

(51) Int. Cl.[7] ..... H01H 3/00

(52) U.S. Cl. ..... 218/154; 218/65; 218/78

(58) Field of Search ..... 218/44, 45, 65, 218/78, 146, 152, 153, 154

(56) References Cited

U.S. PATENT DOCUMENTS

| | | | | | |
|---|---|---|---|---|---|
| 2,476,076 | A | * | 7/1949 | Walle et al. | 218/45 |
| 3,563,102 | A | * | 2/1971 | Bernatt et al. | 218/154 |
| 4,049,936 | A | * | 9/1977 | Frink et al. | 218/154 |
| 4,479,042 | A | * | 10/1984 | Basnett | 218/154 |
| 4,806,716 | A | | 2/1989 | Golowash | |
| 5,350,892 | A | * | 9/1994 | Rozier et al. | 218/154 |

* cited by examiner

*Primary Examiner*—Lincoln Donovan
(74) *Attorney, Agent, or Firm*—James V. Lapacek

(57) ABSTRACT

An electrical power distribution switch includes an operating member that carries a first plurality of spaced switch contacts and a support arrangement for pivotally supporting the operating member. One of the ends of the operating member includes a circumferential bearing surface. The support arrangement cooperates with the circumferential bearing surface. In a preferred arrangement, electrical connections to the spaced switch contacts carried by the operating member are oriented to provide clearance to cable terminations while also simplifying the electrical connection components.

12 Claims, 3 Drawing Sheets

ELECTRICAL POWER DISTRIBUTION SWITCH

This application claims the benefit of U.S. Provisional Application No. 60/128,710 filed on Apr. 8, 1999.

BACKGROUND OF THE INVENTION

1. Field of the Invention

The present invention relates generally to power distribution switches and more particularly to an improved operating member and support structure for pivotally mounted switch blades.

2. Description of Related Art

Various switches and operating mechanisms are shown in the following U.S. Pat. Nos.: 3,563,102; 3,676,629; 3,845,433; 4,293,834; 4,484,046; 4,761,524, 4,806,716, 5,140,117; 5,224,590; 5,504,293 and 5,772,009. For example, U.S. Pat. No. 3,563,102 discloses a quick-make quick-break mechanism for operating a switch between open and closed positions. While these switches and operating mechanisms may be generally suitable for their intended use, it is always desirable to provide improved components and operating characteristics.

SUMMARY OF THE INVENTION

Accordingly, it is a principal object of the present invention to provide an improved operating member and support structure for pivotally mounted switch blades.

This and other objects of the present invention are achieved by an operating member that carries a first plurality of spaced switch contacts and a support arrangement for pivotally supporting the operating member. One of the ends of the operating member includes a circumferential bearing surface. The support arrangement cooperates with the circumferential bearing surface. In a preferred arrangement, electrical connections to the spaced switch contacts carried by the operating member are oriented to provide clearance to cable terminations while also simplifying the electrical connection components.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
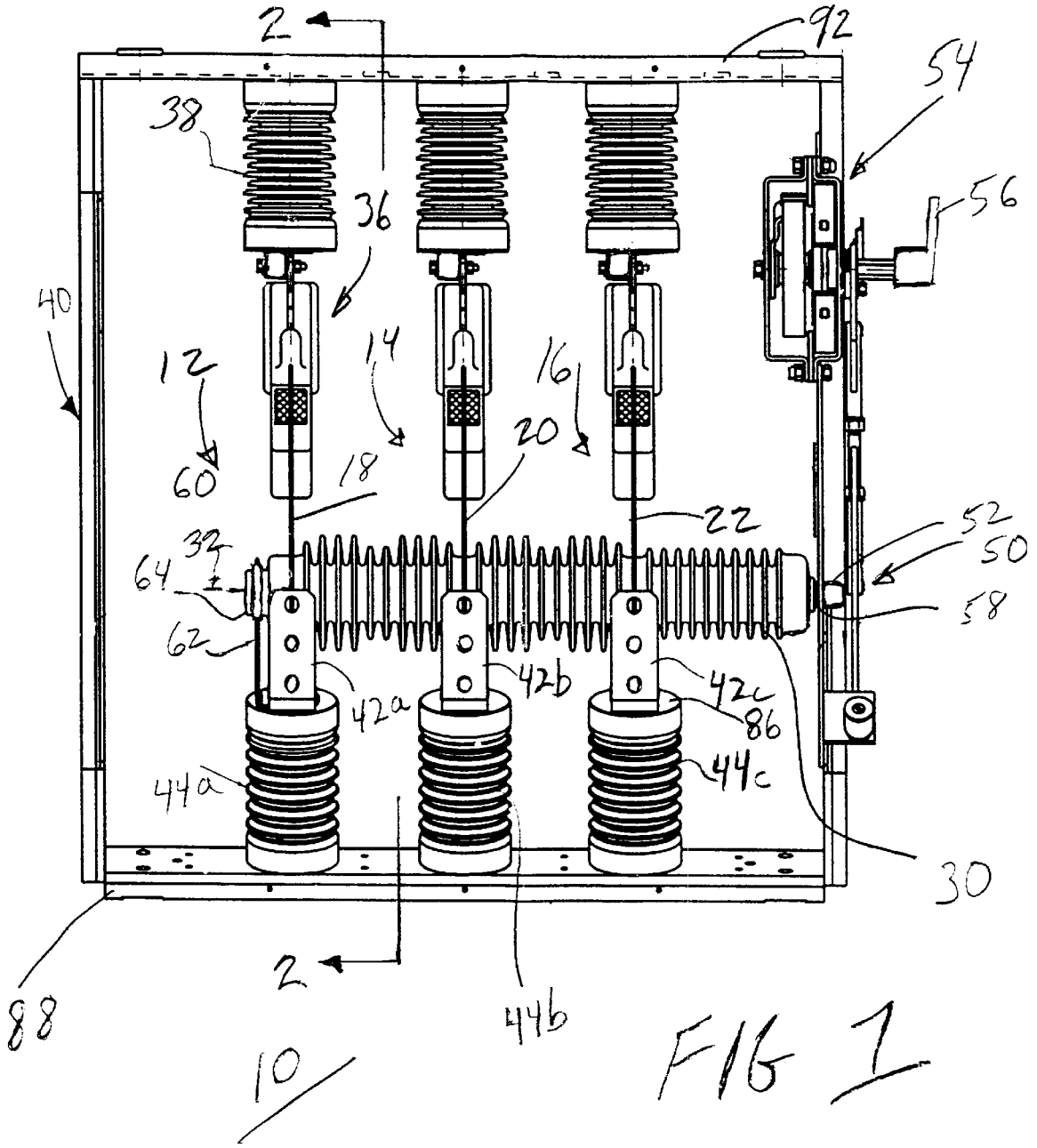
FIG. 1 is a front elevational view of a switch in accordance with the principles of the present invention.
Figure 2:
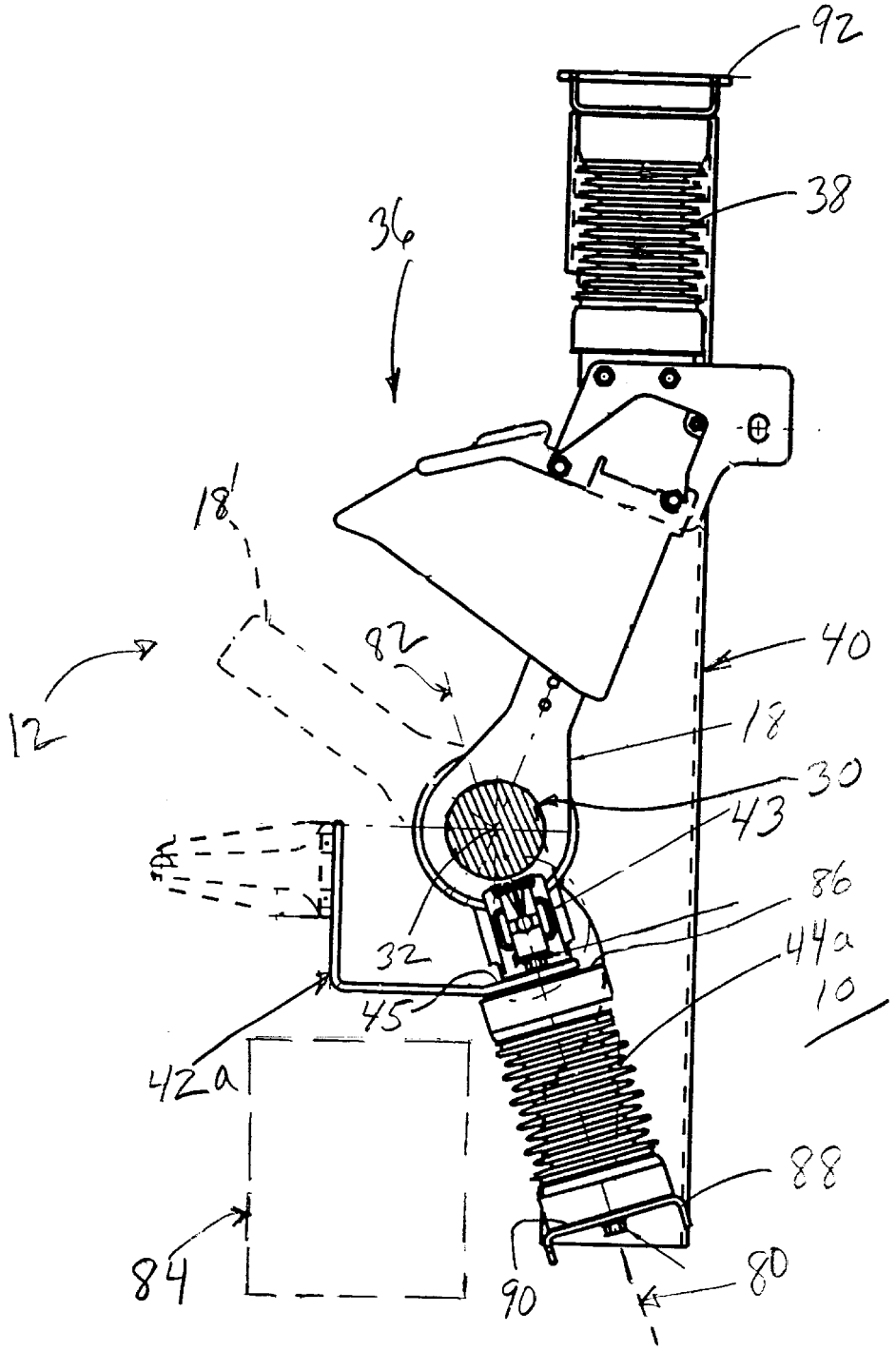
FIG. 2 is a view, partly in section, taken generally along the line 2—2 of FIG. 1.

Referring now to FIGS. 1 and 2, a power distribution switch 10 in accordance with the present invention includes multiple switch poles, e.g. three switch-pole assemblies 12, 14 and 16 as illustrated in the specific embodiment of FIG.

1. In this specific illustrative embodiment, the three switch-pole assemblies 12, 14 and 16 are operable between open and closed positions via pivotally mounted switch blades 18, 20 and 22 respectively, the closed position being shown in FIGS. 1 and 2, the open position shown in phantom in FIG. 2 at 18'. The switch blades 18, 20 and 22 are carried by an operating member 30 that is mounted for pivotal movement about an axis 32 that is substantially horizontal in the illustrative arrangement. Each of the switch-pole assemblies 12, 14 and 16 includes a stationary contact assembly 36 having arc-extinguishing capabilities in the specific embodiment where the switch 10 is a load-interrupting switch. The stationary contact assemblies 36 are each supported by an insulator 38 affixed to a frame 40 of the switch 10. The switch blades 18, 20 and 22 are each electrically connected to a respective lower contact terminal 42 via a sliding contact arrangement provided by lower contact assemblies 43 (FIG. 2) carried by the lower contact terminal 42. The sliding contact feature is also commonly referred to as a wiping contact. The lower contact terminals 42 are supported with respect to the frame 40 at planar portions 45 (FIG. 2) via insulators 44, for example, lower contact terminals 42*a, b* and *c* supported by respective insulators 44*a, b* and *c*.

The operating member 30 is rotated via a linkage 50 that connects an operating shaft 52 of the operating member 30 to be driven by an operating mechanism 54. The operating mechanism 54 is a stored energy device that is operated by a handle 56. The operating member 30 is rotatably mounted at a first end by the operating shaft 52 within a bearing 58. The opposite end of the operating member 30 is pivotally supported at 60 via a support bracket 62 that is affixed to the support insulator 44. In a specific embodiment, the support bracket 62 is conductive. Thus, in operation, the support bracket 62 is energized at the same potential as the lower contact terminal 42.

Figure 5:
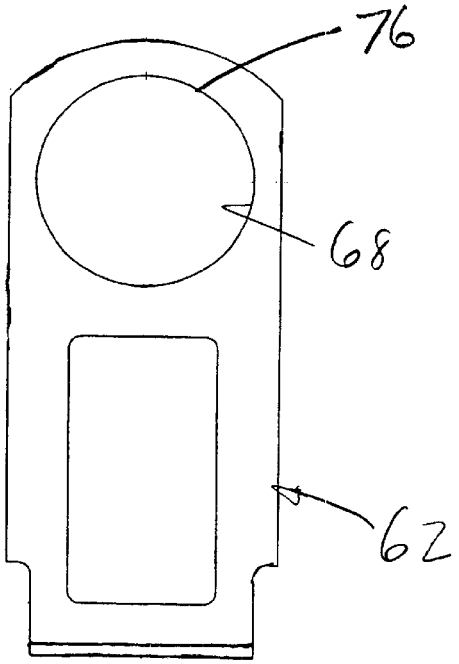
FIG. 5 is a right-side elevational view of a support bracket for the bearing and operating member of the switch of FIGS. 1–4.
Figure 3:
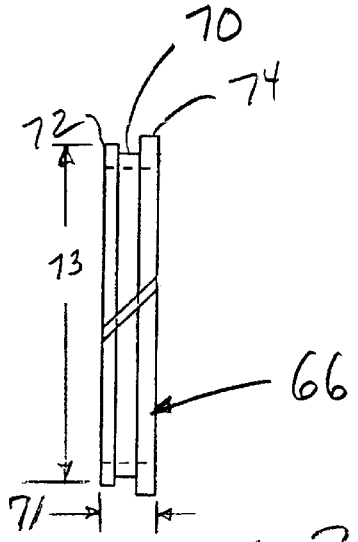
FIG. 3 is an elevational view of a bearing for an operating member of the switch of FIGS. 1 and 2.
Figure 4:
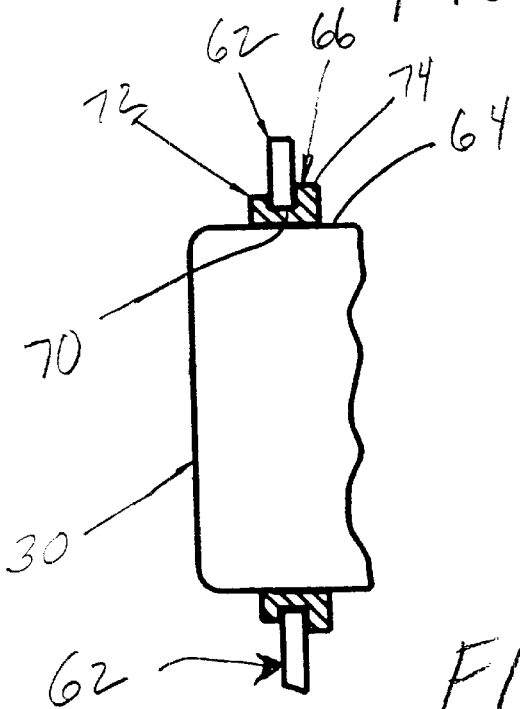
FIG. 4 is an enlarged view, partly in section, of portions of the switch of FIG. 1 illustrating the support of the operating member of the switch of FIGS. 1 and 2.

With additional reference to FIGS. 3–5, the operating member 30 includes a cylindrical bearing surface 64 (FIGS. 1 and 4) that is received within a bearing 66 carried within a circular receiving opening 68 (FIG. 5) of the support bracket 62. The bearing 66 is of split ring construction (FIG. 3) and is retained within a circular receiving opening 68 of the support bracket 62 via the cooperation between a groove 70 and shoulders 72, 74 on the perimeter of the bearing 66 and the rim 76 of the receiving opening 68 of the support bracket 62. In this way, the bearing 66 is installed within the rim 76 of the receiving opening 68 and the inserted operating member 30 in the vicinity of the cylindrical bearing surface 64 locks or retains the operating member 30 and the bearing 66 within the support bracket 62. In a specific embodiment, the bearing 66 is fabricated from molybdenum-impregnated nylon, while the operating member 30 is fabricated from cycloaliphatic epoxy resin. This combination has been found suitable to accomplish the high speed operation and support of the operating member 30 via the quick-make, quick-break operating mechanism 54 of the switch 10. In accordance with this configuration, it has been found possible to achieve a low ratio between the axial length 71 and the diameter 73 of the bearing 66, e.g. on the order of 1:6 as illustrated in FIGS. 3 and 4. This low ratio is useful to minimize the axial lengths of the bearing 66 and the cylindrical bearing surface 64, the overall length of the operating member 30, and the distance by which the operating member 30 and the support bracket 62 extend beyond the support insulator 44*a*, with resultant economies of space and component sizes.

It has been found desirable to mount the contact assemblies 43 so as to be aligned along the path between the center 32 of the operating member 30 and the base of the support insulators 44. In that way any movement of the insulators that may be caused by extreme loading results in movement of the contact assemblies 43 more nearly along the circumferential surface contact of the switch blades 18, 20 and 22. For example, different mounting orientations result in movement of the contact assemblies in a direction that tends to separate the contact assemblies from the switch blades 18, 20 and 22. In accordance with additional aspects of the present invention, the insulators 44 supporting the operating member 30 are oriented such that their longitudinal axes, e.g. 80, are aligned with respect to the radial axis 82 of the operating member 30 as seen in FIG. 2 but not directly below the operating member 30. This orientation provides for preservation of space in the cable termination area, generally referred to at 84 beneath and to the rear of the lower contact terminals 42, while also simplifying the mounting of the lower contact terminals 42 and the lower contact assemblies 43 to the support insulators 44. Specifically, this permits mounting of the planar portions 45 of the lower contact terminals 42 and the lower contact assemblies 43 directly to an upper planar surface 86 of the support insulators 44 which simplifies the shape and fabrication of the lower contact terminals 42 and the lower contact assemblies 43 and avoids the need for additional parts to mount these components. As seen in FIG. 2, a lower mounting member 88 of the frame 40, to which the lower planar surfaces 90 of the insulators 44 are mounted, is tilted or inclined with respect to the generally planar configuration of the switch 10 and the frame 40 and an upper mounting member 92 of the frame 40 to which the upper support insulators 38 are mounted. The generally planar configuration of the switch 10 and the frame 40 are typically arranged vertically for application in metal-enclosed gear.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. An electrical power distribution switch comprising an operating member carrying a first plurality of spaced switch contacts;

support means for pivotally supporting said operating member, said support means comprising first means for pivotally supporting a first end of said operating member and second means for pivotally supporting a second end of said operating member, said operating member comprising a circumferential bearing surface at said second end, said support means comprising means for cooperating with said circumferential bearing surface; and terminal connection means cooperating with and providing electrical connection to each of said first plurality of spaced switch contacts, said support means comprising a support member and a bearing member carried at a first end of said support member for receiving said circumferential bearing surface at said second end of said operating member, said support member having a second end extending from a first of said terminal connection means.

2. The combination of claim 1 wherein said support member is conductive and in contact with said first of said terminal connection means.

3. The combination of claim 1 wherein said support member includes a circumferential receiving opening for receiving said bearing member.

4. The combination of claim 3 wherein said bearing member includes a central circumferential groove for interfitting with said receiving opening of said support member.

5. The combination of claim 1 wherein said operating member comprises means for insulating said first plurality of spaced switch contacts from each other so as to carry said first plurality of spaced switch contacts in spaced insulated relationship.

6. The combination of claim 1 further comprising operating mechanism means for selectively driving said operating member between open and closed positions.

7. The combination of claim 6 wherein said operating mechanism comprises stored energy means for storing energy to operate said operating mechanism means.

8. The combination of claim 7 wherein said operating mechanism means further comprises means for selectively releasing said stored energy means to rapidly move said operating member between open and closed positions.

9. The combination of claim 1 further comprising a second plurality of spaced stationary contacts for cooperation with first plurality of space switch contacts to provide open and closed circuit paths via movement of said operating member.

10. The combination of claim 1 further comprising support means for insulating and supporting said terminal connection means.

11. The combination of claim 10 wherein said support means comprises at least one insulator having a longitudinal axis that is oriented so as to be aligned with a radial axis defined by said operating member.

12. The combination of claim 11 wherein the switch defines a plane and said at least one insulator is inclined with respect to the switch.

* * * * *